US010371100B2

(12) United States Patent
Dyess et al.

(10) Patent No.: US 10,371,100 B2
(45) Date of Patent: Aug. 6, 2019

(54) CARBURETOR AND METHODS THEREFOR

(71) Applicant: Technology Elevated Holdings, LLC, Kansas City, MO (US)

(72) Inventors: William C. Dyess, Laramie, WY (US); Aaron Aldrich Hudlemeyer, Laramie, WY (US)

(73) Assignee: Technology Elevated Holdings, LLC, Kansas City, MO (US)

( * ) Notice: Subject to any disclaimer, the term of this patent is extended or adjusted under 35 U.S.C. 154(b) by 777 days.

(21) Appl. No.: 14/458,482

(22) Filed: Aug. 13, 2014

(65) Prior Publication Data

US 2015/0028501 A1 Jan. 29, 2015

Related U.S. Application Data

(60) Division of application No. 13/807,999, filed as application No. PCT/US2011/039254 on Jun. 6, 2011, now abandoned, which is a continuation-in-part of application No. 12/913,629, filed on Oct. 27, 2010, now Pat. No. 8,931,458.

(Continued)

(51) Int. Cl.
*F02M 7/18* (2006.01)
*F02M 19/02* (2006.01)

(Continued)

(52) U.S. Cl.
CPC ..... *F02M 7/18* (2013.01); *F02M 19/02* (2013.01); *F02M 19/04* (2013.01); *F02M 19/081* (2013.01); *F02M 19/088* (2013.01)

(58) Field of Classification Search
CPC .... F02M 19/088; F02M 19/081; F02M 19/02; F02M 19/04; F02M 19/0221;

(Continued)

(56) References Cited

U.S. PATENT DOCUMENTS 1,344,696 A * 6/1920 Huber ..... F02M 1/16 137/205
1,373,498 A * 4/1921 Gaff ..... F02M 51/0653 123/169 R (Continued)

FOREIGN PATENT DOCUMENTS

JP 04371561 A * 12/1992 ..... F16D 23/025
JP 04371561 A * 12/1992 ..... F16D 23/025
WO 2000020750 4/2000

OTHER PUBLICATIONS

NPL Lectron Patented Metering Rod; archived website;published Jan. 16, 2006.*

(Continued)

*Primary Examiner* — Sizo B Vilakazi
*Assistant Examiner* — Brian R Kirby
(74) *Attorney, Agent, or Firm* — Honigman LLP; Andrew S. Chipouras; Douglas H. Siegel

(57) ABSTRACT

A carburetor having an inlet opening that includes a pair of concavities operative to direct air toward the metering rod of the carburetor. A carburetor having an inlet opening that includes an arcuate manifold adjacent to the inlet opening and in fluid communication with a fuel reservoir. A carburetor having a slide assembly that includes a positioning mechanism operative to adjust the position of the metering rod relative to the throttle slide. A throttle slide that includes a flow guide that bisects an arcuate relief on an underside thereof. A method for configuring the throat of a carburetor that includes an upper portion of a first diameter and a lower portion of a second diameter that is offset from the first diameter. The method comprises deriving an optimum size for the first and second diameters and the offset based on the pumping efficiency and operating parameters of the engine.

19 Claims, 13 Drawing Sheets

Related U.S. Application Data

(60) Provisional application No. 61/361,117, filed on Jul. 2, 2010.

(51) Int. Cl.
*F02M 19/04* (2006.01)
*F02M 19/08* (2006.01)

(58) Field of Classification Search
CPC ..... F02M 7/14–7/18; F02M 5/125; F02M 17/26; F02M 9/02
USPC ..... 123/434–442; 261/44 B, 44.6, 78.1; 239/44
See application file for complete search history.

(56) References Cited

U.S. PATENT DOCUMENTS 1,375,898 A * 4/1921 Ciglia ..... F02M 1/046 261/41.1
1,478,255 A * 12/1923 Reid ..... F23D 11/10 239/13
1,506,364 A * 8/1924 Hippolyte ..... G10D 9/023 84/383 A
1,561,967 A * 11/1925 Buick ..... F02M 1/02 261/41.1
1,611,234 A * 12/1926 Whittaker ..... F02M 19/03 261/104
1,931,259 A * 10/1933 Kirby ..... F02M 1/16 261/121.3
2,200,723 A * 5/1940 Reichhelm ..... F02D 9/02 48/189.4
2,203,858 A * 6/1940 Booty ..... F02M 9/127 261/39.2
2,230,933 A * 2/1941 Raymond ..... G10D 9/023 84/383 R
2,372,532 A * 3/1945 Stewart ..... F02M 19/035 261/78.1
2,681,216 A * 6/1954 Knecht ..... F02M 19/03 293/433
2,995,349 A * 8/1961 Kennedy, Sr. ..... F02M 61/00 261/41.1
3,084,865 A * 4/1963 Fleer ..... F23N 5/067 138/46
3,266,309 A 8/1966 Bernard
3,271,014 A * 9/1966 Wu ..... F02M 7/133 261/39.2
3,679,186 A * 7/1972 Hideg ..... F02M 7/00 261/50.1
3,709,469 A * 1/1973 Edmonston ..... F02M 9/06 261/44.3
3,754,540 A * 8/1973 Bedard ..... F02D 9/00 123/353
3,822,058 A * 7/1974 Carter ..... F02M 9/06 261/44.3
3,829,069 A * 8/1974 Hailstone ..... F02M 3/08 261/44.3
3,887,759 A * 6/1975 Staub ..... H01F 27/18 165/104.24
3,957,930 A * 5/1976 Birmingham ..... F02M 9/06 261/44.3
3,965,221 A * 6/1976 Englert ..... F02M 7/16 261/23.2
3,985,839 A * 10/1976 Edmonston ..... F02M 9/06 261/44.3
4,008,298 A * 2/1977 Quantz ..... F02M 9/06 251/85
4,013,741 A * 3/1977 Edmonston ..... F02M 9/06 251/903
4,034,028 A 7/1977 Tsoi-Hei Ma
4,102,952 A * 7/1978 Snipes ..... F02M 7/18 261/44.2
4,148,932 A * 4/1979 Tada ..... B05B 5/0407 239/3
4,150,070 A 4/1979 Hashimoto et al.
4,206,158 A 6/1980 Wood
4,221,747 A * 9/1980 Edmonston ..... F02M 1/043 261/44.3
4,250,856 A 2/1981 Abbey
4,263,780 A * 4/1981 Stettler ..... F23R 3/30 60/39.23
4,301,968 A * 11/1981 Berger ..... B05B 17/0623 239/102.2
4,302,404 A * 11/1981 Nakamura ..... F02M 7/17 261/44.4
4,371,478 A * 2/1983 Wada ..... F02M 7/17 261/44.4
4,442,046 A * 4/1984 Edmonston ..... F02M 1/16 261/44.3
4,465,643 A * 8/1984 Isoya ..... F02M 7/17 261/44.4
4,472,322 A * 9/1984 Isoya ..... F02M 7/17 261/44.4
4,559,185 A 12/1985 Seto
4,572,809 A * 2/1986 Bothwell ..... F02D 9/101 261/44.2
4,634,560 A 1/1987 Eckert
4,670,194 A * 6/1987 Buford ..... F02M 69/08 261/121.2
4,814,115 A 3/1989 Hashimoto et al.
4,913,350 A * 4/1990 Purzycki ..... A61L 9/127 239/44
4,926,059 A 5/1990 Edmonston
5,300,259 A * 4/1994 Tashiro ..... F02M 9/06 251/122
5,342,555 A 8/1994 Edmonston
5,538,673 A 7/1996 Edmonston
5,910,039 A * 6/1999 Primos ..... A01M 31/004 446/207
6,178,564 B1 * 1/2001 Leonard ..... E03D 9/032 4/223
6,273,403 B1 * 8/2001 Kahlhamer ..... F02M 9/06 261/44.3
6,435,481 B2 * 8/2002 Kahlhamer ..... F02M 9/06 261/50.2
6,505,821 B1 1/2003 Edmonston
6,820,864 B2 * 11/2004 Amou ..... F02M 15/04 123/549
6,827,339 B1 12/2004 Wang
6,898,806 B2 * 5/2005 Keramidas ..... E03D 9/032 4/223
7,547,004 B2 * 6/2009 Hsu ..... F24F 6/02 261/104
2004/0060997 A1 * 4/2004 Jones ..... A01M 1/2033 239/44
2006/0289669 A1 * 12/2006 McGee ..... A61L 9/127 239/45
2007/0012803 A1 * 1/2007 Shimizu ..... F02M 61/162 239/497
2007/0157617 A1 * 7/2007 von der Bank ..... F23D 11/107 60/743
2007/0243790 A1 * 10/2007 May ..... A01M 31/004 446/207
2008/0203185 A1 * 8/2008 Brown ..... A01M 1/2044 239/44
2009/0100837 A1 * 4/2009 Von Der Bank ..... F23R 3/14 60/737
2009/0283611 A1 * 11/2009 Varanasi ..... B05B 7/066 239/366
2009/0301092 A1 * 12/2009 Wilbraham ..... F23R 3/14 60/748
2012/0001113 A1 1/2012 Dyess
2013/0206107 A1 8/2013 Dyess et al.

OTHER PUBLICATIONS

NPL Scientists Create Metal that pumps liquid uphill; internet article, published Jun. 2, 2009.*

(56) References Cited

OTHER PUBLICATIONS

International Search Report for Int. Appl. No. PCT/US2011/039254, dated Jan. 2, 2012.
Supplementary European Search Report for European Patent Application No. 11801310, dated Jan. 8, 2014.

* cited by examiner

CARBURETOR AND METHODS THEREFOR

CROSS-REFERENCE TO RELATED APPLICATIONS

The present application is a divisional of U.S. application Ser. No. 13/807,999 which claims the benefit of PCT/US2011/039254 filed on Jun. 6, 2011. PCT/US2011/039254 is a continuation in part of application Ser. No. 12/913,629 filed Oct. 27, 2010, which claims the benefit of U.S. Provisional Application No. 61/361,117, filed Jul. 2, 2010. Each of these disclosures are hereby incorporated by reference in their entirety.

BACKGROUND

Carburetors are reliable, robust mechanisms for efficiently metering fuel to an internal combustion engine. A carburetor meters the appropriate amount of fuel according to engine demand based on intake airflow to the engine. Generally, carburetors operate on the principle that as the velocity of airflow through a restriction increases, its pressure decreases. Carburetors are configured to take advantage of the pressure differential created between atmospheric pressure surrounding the carburetor and a low pressure region created inside the carburetor, usually by way of a venturi. As an engine draws air through the venture, the low pressure region created by the increasing air velocity meters a proportional amount of fuel into the intake airflow stream. As passive devices, carburetors are both reliable and robust, while thoroughly mixing fuel with incoming airflow which enhances efficient combustion.

While carburetors are simple and cost effective fuel delivery systems, modern emission requirements have limited the application of carburetors on newer products. Many applications have implemented electronic fuel injection in order to maintain precise control of fuel delivery, which allows catalytic converters to be used in an emissions reduction strategy. The introduction of electronic fuel injection has added complexity, cost, weight, and increased electronic load to modern engines. Fuel injection systems rely on a sensor network. The failure of any single sensor can drastically reduce the emissions performance of the fuel system.

In order to continue to benefit from the carburetor's advantages, improvements to traditional carburetor design are needed in order to ensure the carburetor's ability to meet emission requirements for modern engines.

SUMMARY

Provided herein is a carburetor for an internal combustion engine, comprising a body having an air inlet opening portion, an air outlet opening portion, and a throat portion extending there between. A fuel reservoir is in fluid communication with the throat portion and a slide assembly is movably disposed in the body for movement across the throat portion. The slide assembly includes a throttle slide and a metering rod extending across the throat portion and into the fuel reservoir. The air inlet opening includes a pair of concavities operative to direct airflow toward the metering rod. The concavities begin near a peripheral margin of the inlet opening portion and extend inward as the concavities approach the throat portion. The throat portion includes upper and lower portions and the concavities are adjacent the upper portion.

Also contemplated herein is a carburetor having an air inlet opening that includes a manifold, which may be in the form of an arcuate scoop, adjacent to and extending along a portion of a peripheral margin of the inlet opening portion. The manifold is in fluid communication with the fuel reservoir. The manifold has a volume that is proportional to the cross-sectional area of the throat portion. The throat portion includes upper and lower portions, and the manifold is adjacent the upper portion. This carburetor may also include an air inlet opening that includes a pair of concavities operative to direct airflow toward the metering rod that are located proximate either end of the manifold. Wherein the concavities begin near a peripheral margin of the inlet opening portion and extend inward as the concavities approach the throat portion.

In another embodiment, a carburetor for an internal combustion engine is contemplated that includes a slide assembly movably disposed in the body for movement across the throat portion. The slide assembly includes a throttle slide having a metering rod bore and a positioner bore. A metering rod extends through the metering rod bore and across the throat portion into the fuel reservoir. The slide assembly includes a positioning mechanism operative to adjust the position of the metering rod relative to the throttle slide. The positioning mechanism includes a barrel rotatably disposed in the positioner bore. The barrel is threadably engaged with the metering rod such that rotation of the barrel adjusts the position of the metering rod.

The barrel includes a detent for selectively indexing the barrel in one of a plurality of rotational positions. The detent is operative to engage one of a plurality of indentations located at the bottom of the positioner bore. The indentations may be formed in the bottom of the positioner bore or formed in a detent washer disposed in the bottom of the positioner bore, as examples.

In yet another embodiment, a carburetor for an internal combustion engine is contemplated that includes a throttle slide having an outlet gate and an inlet gate including a flow guide disposed on the inlet gate in alignment with the metering rod. The flow guide bisects an arcuate relief on an underside of the inlet gate thereby forming a pair of funnel-shaped grooves. The arcuate relief may be frusto-conical in configuration and the flow guide may be in the form of a pyramid shaped point. Furthermore, the throttle slide may include a stepped portion disposed on the inlet gate for accelerating an airflow past a lower end of the throttle slide.

A method for configuring the throat of a carburetor to optimize airflow to an engine is also contemplated. Where the carburetor includes an upper portion of a first diameter and a lower portion of a second diameter that is offset from the first diameter, the method comprises deriving an optimum size for the first and second diameters and the offset based on mass airflow requirements of an engine. Broadly, the method comprises determining the venturi flow coefficient (Cv) of the carburetor and determining the mass airflow requirements ($\dot{m}$) of the engine. The optimum size for the first and second diameters and the offset are derived based on the mass airflow requirements and venturi flow coefficient. Both the venturi flow coefficient and the mass airflow requirements may be determined experimentally. In addition, determining the mass airflow requirements of the engine may include measuring the pressure differential ($\Delta P$) and the air density ($\rho$).

The method includes resolving the width (w) as a function of throttle slide position (y) according to the equation $$w(y) = \frac{d}{dy}\left[\frac{\dot{m}}{C_v\sqrt{2\rho\Delta P}}\right].$$

The optimum size for the first diameter ($Ø_1$) is selected to match the width (Wwot) at a wide open throttle slide position (Ywot). The optimum size for the second diameter ($Ø_2$) is selected to match the width ($W_i$) at an idle throttle slide position ($y_i$). The optimum offset (X) is the difference between the wide open throttle slide position (Ywot) and the idle throttle slide position ($Y_i$).

Also contemplated herein is a metering rod for use on a carburetor. The metering rod comprises an elongated cylindrical rod extending along a rod axis and having opposed first and second end portions. A wake generator is formed on the cylindrical rod extending from the first end portion and varying in cross-sectional areas along at least a portion of the length of the cylindrical rod.

In an embodiment, the wake generator comprises a flat region angled with respect to the rod axis and bordered by an elliptical edge. The metering rod may further comprise a plurality of grooves intersecting the elliptical edge.

The wake generator may include grooves that extend parallel to at least a portion of the rod axis and may include an arcuate portion. The wake generator may comprise a concave cross-section, such as, for example, and without limitation a dihedral cross-section.

DETAILED DESCRIPTION

Basic carburetor design is generally well known to those of ordinary skill in the art. For example, a suitable carburetor to which the present improvements may be applied is described in U.S. Pat. No. 6,505,821 issued Jan. 14, 2003 to Edmonston, the disclosure of which is hereby incorporated by reference in its entirety.

Figure 1:
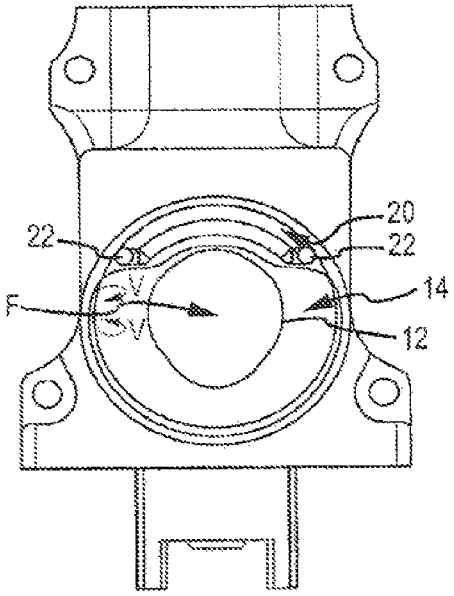
FIG. 1 is a front view in elevation of the carburetor illustrating the flow geometry of the inlet opening portion according to an exemplary embodiment.
Figure 2:
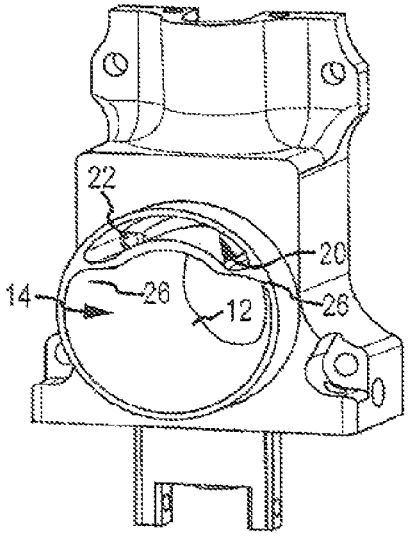
FIG. 2 is a perspective view of the inlet of the carburetor shown in FIG. 1.

FIGS. 1 and 2 illustrate flow geometry designed to concentrate flow near the carburetor's metering rod 10 (see FIGS. 3 and 4) and encourage mixing. The entrance 14 to the throat 12 (known as the bell) includes features to direct flow "F" toward the metering rod 10 and induces a set of secondary vortical structures "V" which increase turbulence intensity and promote mixing. The concavities 26 begin near the upper and outer portion of the venturi and extend downward while turning inward as they approach the flow restriction created by the slide assembly 16. Momentum is carried along the primary curvature of the concavity and collides near the metering rod 10. The flow concentration in the center of the bore helps to minimize the buildup of liquid boundary layers, increases vacuum on the flat (not shown) of the metering rod to draw fuel, and increases shear forces within the flow to force fuel into increasingly smaller droplets. The secondary flow forms two weak, counter-rotating vortices, normal to the primary streamline. The cross-flow momentum helps to mix fuel across streamlines and creates a more uniform mixture.

Figure 3:
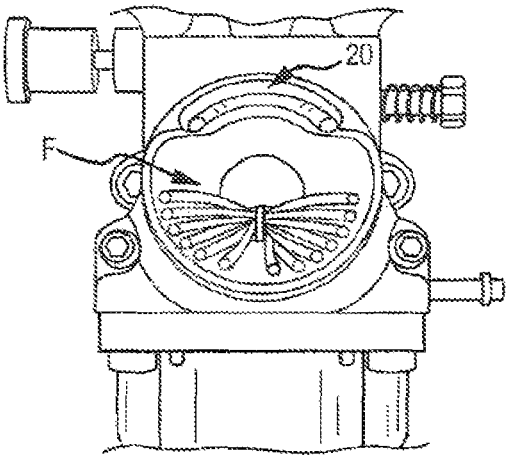
FIG. 3 is a front view of the carburetor illustrating flow characteristics of the inlet opening portion with the throttle slide at partial open throttle.
Figure 4:
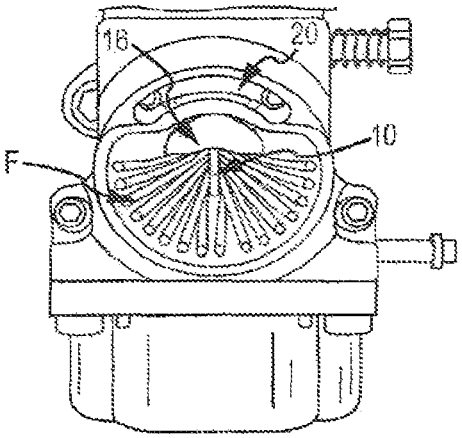
FIG. 4 is a front view of the carburetor illustrating flow characteristics of the inlet opening portion similar to FIG. 3 with the throttle slide at a further open position.
Figure 5:
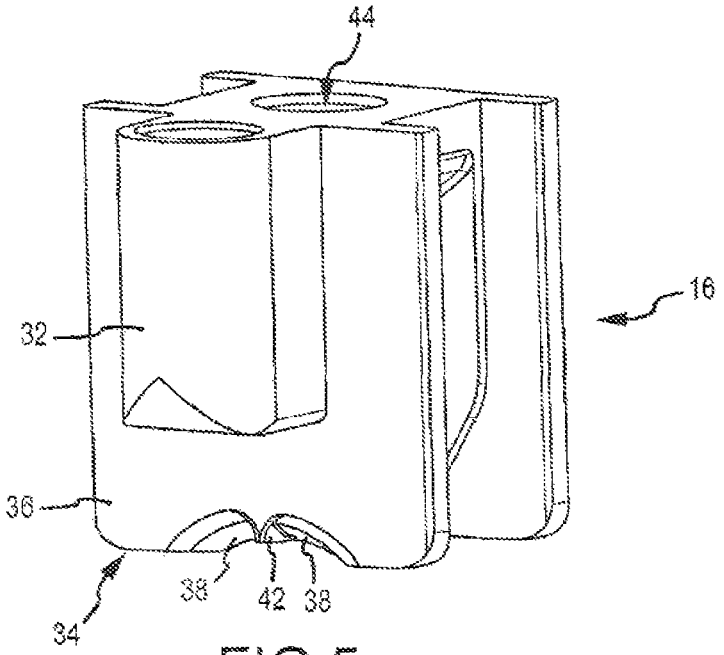
FIG. 5 is a perspective view of the throttle slide according to an exemplary embodiment.
Figure 6:
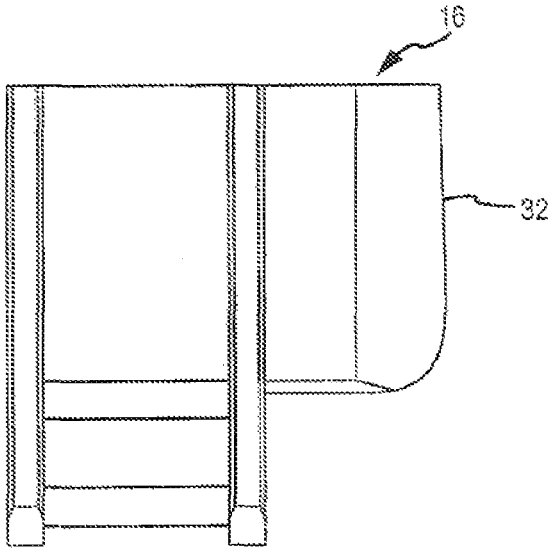
FIG. 6 is a side view in elevation of the throttle slide shown in FIG. 5.
Figure 7:
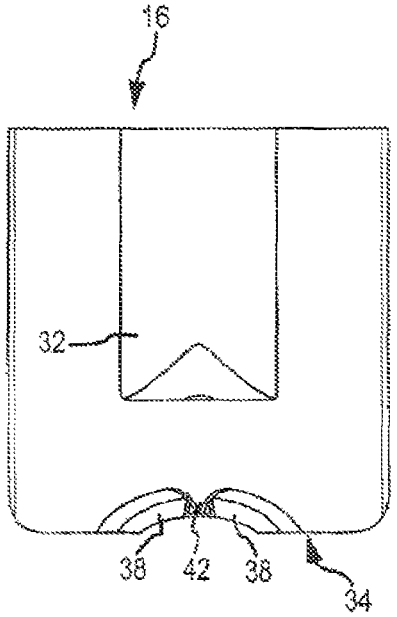
FIG. 7 is a front view in elevation of the throttle slide shown in FIGS. 5 and 6.
Figure 8:
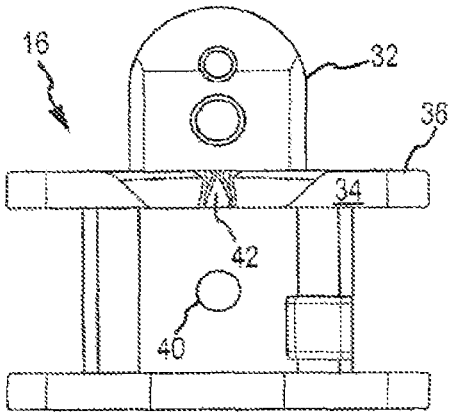
FIG. 8 is a bottom plan view of the throttle slide shown in FIGS. 5-7.

FIGS. 3 and 4 illustrate the vortical flow "F" of air entering the bell, or inlet portion, at different throttle slide positions. FIG. 3 illustrates vortical flow with a small throttle slide opening, such as would be expected at engine idle speeds. FIG. 4, on the other hand, illustrates vortical flow of air entering the bell at a larger throttle slide opening, such as at mid-throttle.

The carburetor, shown in FIGS. 1-4, also includes a manifold 20 designed to maintain a steady atmospheric pressure on the fuel in the float bowl. In this case, manifold 20 is in the form of an arcuate scoop. Steady pressure on the float bowl generates uniform fuel flow and efficient mixing of the fuel with incoming air. The manifold 20 is located in the upper portion of the air inlet adjacent to and extending along a portion of a peripheral margin of the inlet opening portion. The manifold serves to trap the air in a relatively stagnant, non-turbulent state at the entrance to the inlet openings 22 to maintain a constant pressure on the fuel in the float bowl.

The geometry of the manifold 20 may be altered to change some characteristics of the carburetor performance. Turbulent flow enters the manifold and comes to rest. It is this conversion of dynamic pressure into static pressure that applies compensating pressure on top of the fuel reservoir. Both the volume and depth of the manifold are elements that damp oscillations in the flow. The length and diameter of the passages 22 leading to the fuel reservoir are of an appropriate ratio to allow viscosity to dominate the fuel driving pressure. The damping acts only upon the transient pressures encountered by the manifold.

FIGS. 5-8 illustrate the flow-modifying geometry applied to the front gate of the slide assembly, which improve the atomization and metering characteristics of the carburetor. The slide assembly 16 includes a stepped portion 32 upstream of the throat for concentrating and compressing the air entering the throat. The stepped portion 32 forces air entering from the inlet to compress before going under the slide assembly, thereby increasing the velocity of the airflow past the slide and fuel outlet. This is especially effective for the thorough mixing of incoming fuel and air and efficient burning of the fuel-air mixture at low settings of the carburetor.

Figure 9:
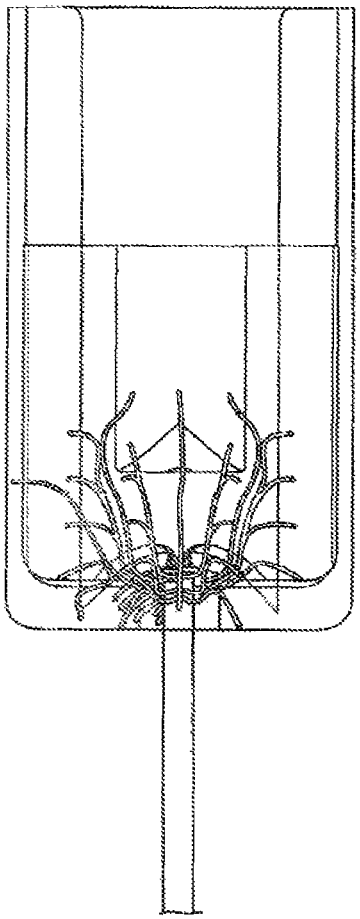
FIG. 9 is a front view of the throttle slide illustrating the pressure changes as airflow enters the carburetor.
Figure 10:
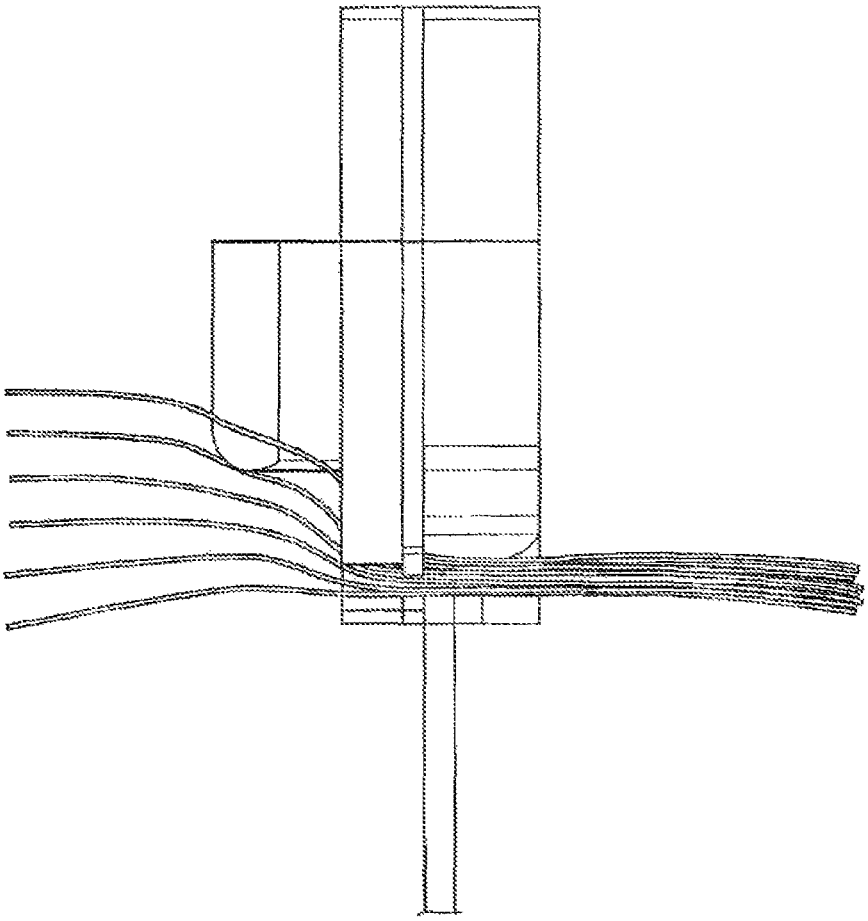
FIG. 10 is a side view of the throttle slide illustrating the pressure changes across the throat of the carburetor.

The underside 34 of the forward gate 36 of the slide includes two funnel-shaped grooves 38 placed directly to either side of the metering rod location 40. The material between the grooves forms a frenulum or flow guide 42, in the form of a pyramid shaped point or chevron, leading into the flow. The flow guide bisects an arcuate relief on the underside of the inlet gate thereby forming a pair of funnel-shaped grooves. The arcuate relief is preferably frustaconical in configuration. Flow guide 42 causes the metering rod to appear to have a teardrop-shape within the flow at low throttle position. The funnel-shaped grooves 38 allow air to accelerate to their highest velocity more near to the metering portion of the venturi increasing atomization. Flow separation and the orthogonal surface vector of the feature reduce lift on the slide, which may cause undesirable fluctuations in the fuel delivery. This design has been shown to improve function in the form of lower NOx emissions and a resistance to slide float. FIGS. 9 and 10 are computational fluid dynamic (CFD) vector plots illustrating the flow characteristics of the frenulum.

With reference to FIGS. 11A-12B, throat 12 includes a lower portion 15 that is narrower in width than the upper portion 13. Lower portion 15 is operative to accelerate airflow past the lower end of the throttle slide 16 at part throttle for the purpose of amplifying the signal at the metering rod 10. As the throttle slide 16 is opened further, the larger upper portion 13 is exposed to provide increased airflow to the engine at higher engine speeds and/or loads.

In one embodiment, the geometry of the throat 12 includes an upper portion 13 of a first diameter and a lower portion 15 of a second diameter that is offset a distance "X" from the first diameter. The sizes of the circle(s) determine the throttle bore size.

Figure 11A:
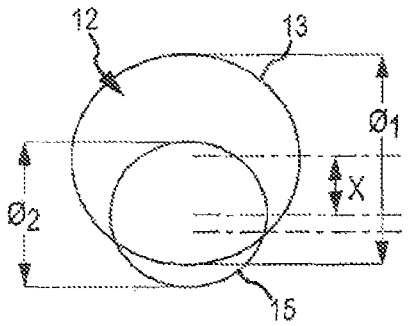
FIG. 11A is a schematic diagram of the throat portion of the carburetor illustrating the upper and lower portions.
Figure 11B:
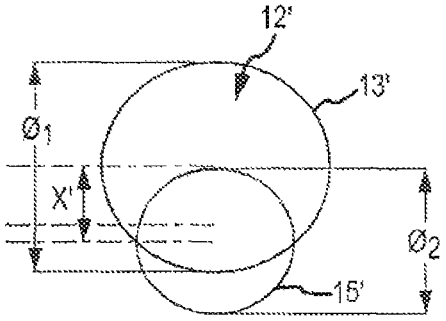
FIG. 11 B is a schematic diagram of the throat portion similar to FIG. 11A, illustrating a variation in the offset of the upper and lower portions.
Figure 12A:
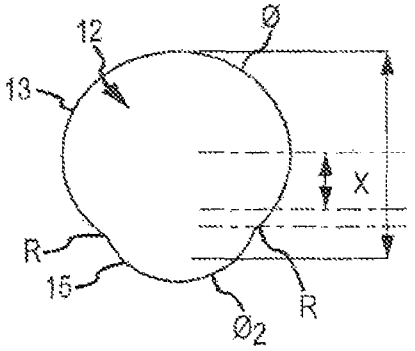
FIG. 12A is a schematic diagram corresponding to FIG. 11 A showing an exemplary throat portion profile.
Figure 12B:
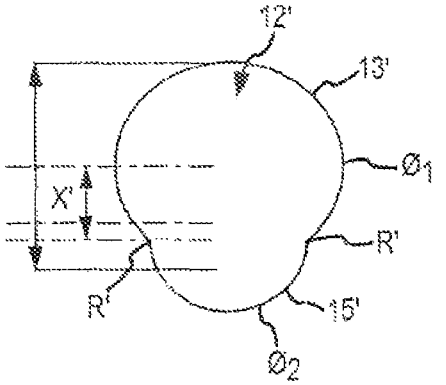
FIG. 12B is a schematic diagram corresponding to FIG. 11 B showing an alternate exemplary throat portion profile.

FIG. 11A illustrates an example of a geometry configuration for throat 12 having a first diameter (Ø1) equal to 3.40 cm and a second diameter (Ø2) equal to 2.35 cm with an offset "X" between the first and second diameters. FIG. 11B illustrates another example of geometry configuration for throat 12'. In this example, the first and second diameters are the same as in FIG. 11A; however, the offset distance "X'" has been increased. The larger offset distance "X'" provides a more progressive transition between idle and wide open throttle, which is suitable for a 4-stroke engine, for example. FIG. 11A illustrates geometry that is better suited to a 2-stroke engine and provides a more abrupt transition between idle and wide open throttle or near wide open throttle. As can be appreciated in FIGS. 12A and 12B, the two diameters corresponding to upper and lower portions 13 and 15, respectively, are smoothed together by a radius "R" to provide a smooth air intake surface.

Methods for configuring the throat of a carburetor, such as described above, are also contemplated. The geometry (Ø1, Ø2, X) of throat 12 may be optimized to improve airflow to an engine depending on the engine parameters. Several parameters of carburetor design may be optimized in a prescribed fashion to achieve the highest atomization efficiency and flow for improved performance of an internal combustion engine.

Generally, the method uses the mass airflow requirements ($\dot{m}$) for a particular engine to define the carburetor venturi profile. The mass airflow requirements ($\dot{m}$) are obtained by direct measurement and isolation of the air delivery requirements of a particular engine. The airflow requirements are combined with carburetor venturi flow coefficients (Cv) to define the required throat or venturi area (Av) as a function of throttle slide position.

Regarding measurement of the mass airflow requirements ($\dot{m}$), piston engines, both two-cycle and four-cycle, consume air as part of an unsteady process. Air metering technology is not optimally suited for net mass flow measurement of this unsteady flow. It is advantageous to damp out these perturbations and flow reversions in the case of some two-cycle engines in order to support accurate measurements. Accordingly, the inlet port of the engine is ducted to a vessel of sufficient volume to suppress the effects of unsteady pumping action such that the volume of the vessel is much greater than the displacement of the engine. The vessel is then supplied air at a pressure equivalent to atmospheric or desired conditions by a rotary style blower, for example. Mass flow of air ($\dot{m}$) is measured at the intake of the blower which provides a smooth continuous flow.

Once mass flow ($\dot{m}$) is determined as a function of engine speed and load, the carburetor venturi cross section is calculated. Using the incompressible form of Bernoulli's equation and one-dimensional continuity equation, an equation for ideal mass flow rate can be shown.

$$\dot{m}=A_v\sqrt{2\rho\Delta p}$$

$\dot{m}$=Mass Flow Rate of Air $A_v$=Area of Carburetor Venturi, where Av=f(Slide Position)

p=Air Density

ΔP=Static Pressure Differential of Venturi vs. Atmosphere

Geometry, turbulence, and viscous effects all contribute to reduce the mass flow rate below indicated by the ideal expression. For standard venturi tube profiles, flow coefficients are experimentally determined and included in the mass flow equation. A flow coefficient ($C_v$) specific to the subject carburetor is similarly determined by experimentation. This coefficient is itself a function of area ratio or slide position, density, and pressure differential. The modified equation is shown below:

$$\dot{m}=A_vC_v\sqrt{2\rho\Delta P}$$

$$C_v=f(a,\Delta P,\text{slide position})$$

The mass flow rate ($\dot{m}$), pressure differential (ΔP), and venturi flow coefficient ($C_v$) are all determined by experimentation as described above, while the density (p) is measured directly from the environment. The mass flow equation can then be solved, as described more fully below, to give an expression for area ($A_v$) as a function of throttle position (y).

$$A_v = \frac{\dot{m}}{C_v\sqrt{2\rho\Delta P}}$$

Figure 22:
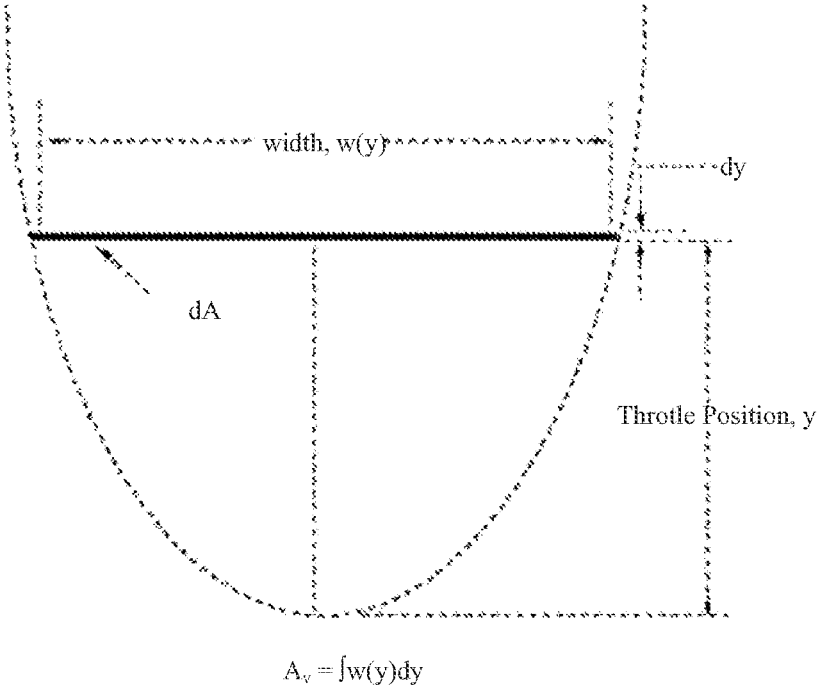
FIG. 22 is a cross-sectional view of a shape according to an alternative embodiment.
Figure 23:
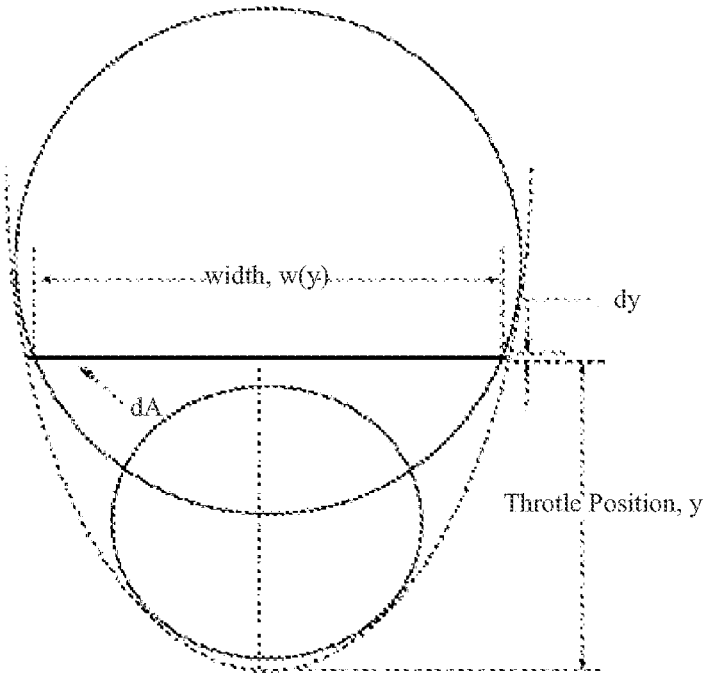
FIG. 23 is a cross-sectional view of a shape according to yet another alternative embodiment.

For an arbitrary venturi profile, the area of the revealed shape can be described in relation to the shapes in FIGS. 22-23.

Combining the mass flow rate equation with the area integral, and solving for the width (w) returns the following expression.

$$w(y) = \frac{d}{dy}\left[\frac{\dot{m}}{C_v\sqrt{2\rho\Delta P}}\right]$$

This equation for width (w) as a function of throttle position (y) describes the venturi geometry. As can be appreciated with reference to the integral below, the ideal throat 12 geometry is approximated with two diameters (Ø1, Ø2) separated by a distance (X).

By matching the throat cross section to the engine's characteristics, combustion is improved by improved flow, increased atomization, and consistent fuel delivery. Furthermore, a carburetor tailored, according to the above defined method, will deliver a fuel mixture that is more uniform and consistent and provides a progressive, linear throttle response to the user.

Figure 13:
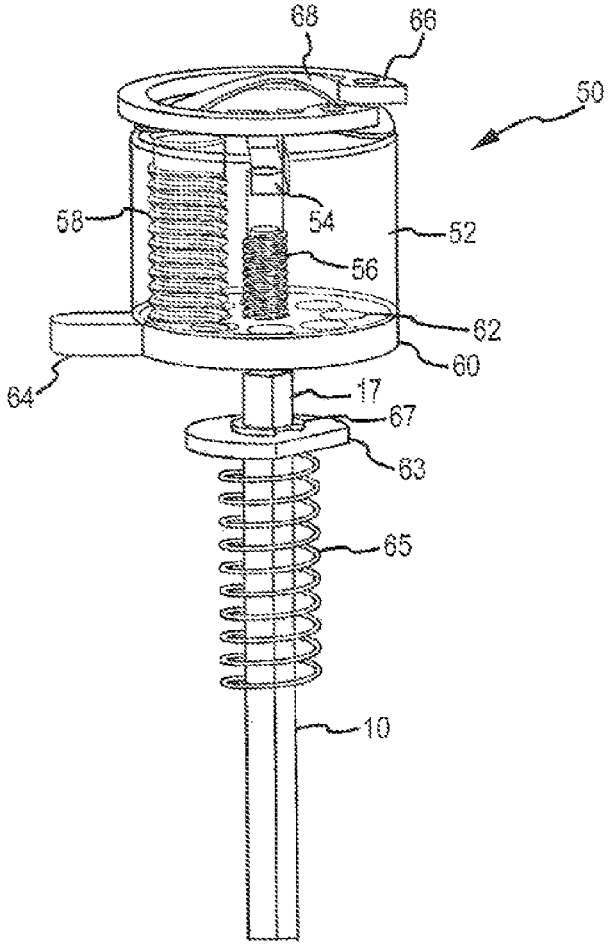
FIG. 13 is a partial perspective view of the metering rod positioning mechanism according to an exemplary embodiment.

Turning now to FIG. 13, an exemplary metering rod positioning mechanism 50 is described. As is known in the art, adjusting the position of the metering rod 10 relative to the throttle slide 16 acts to enrich or lean the mixture of air and fuel delivered to an engine. Positioning mechanism 50 actuates the metering rod 10 independently from the slide assembly 16. A cylinder or barrel 52 has a thread 56 through the center to accept the metering rod 10. As the barrel 52 is indexed rotationally, threaded contact alters the axial position of the metering rod 10. Barrel 52 includes a spring plunger 58 that is threadably engaged with the barrel 52. The spring plunger or detent 58 is operative to engage one of a plurality of indentations or divots 62. Thus, the barrel 58 may be selectively indexed into one of the rotational positions and wherein the detent 58 maintains the barrel position until readjusted. Barrel 52 is received in positioner bore 44 (See FIG. 5). Indentations 62 may be formed in the bottom of bore 44 or may be formed into a separate detent washer 60 disposed in the bottom of bore 44. Detent washer 60 may also include a tab 64 to maintain its angular position relative to the slide assembly. Barrel 52 is retained in bore 44 with a snap ring 66 and a wave washer 68. In this case, barrel 52 includes a slot 54 to allow rotational adjustment of the barrel with a suitable tool, such as a screw driver. Metering rod positioning mechanism 50 may be replaced by or incorporate a motor, such as a small scale servo or steppermotor, to electronically control the positioning of the metering rod 10.

Metering rod 10 is fashioned with a flat 17 to engage a D-shaped washer 63 that is fixed in position by a spring tension from below (spring 65) and a retaining ring 63 from above. The D-shaped washer 63 engages a contour (not shown) within the slide assembly 16 to maintain the angular orientation of the metering rod 10 with respect to the throttle slide 16 and throat portion 12.

Figure 14:
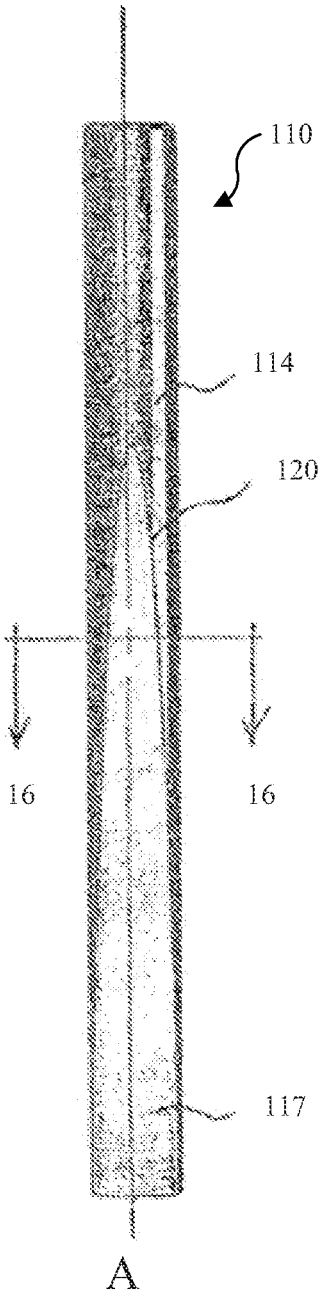
FIG. 14 is a front view of a metering rod according to an exemplary embodiment.
Figure 15:
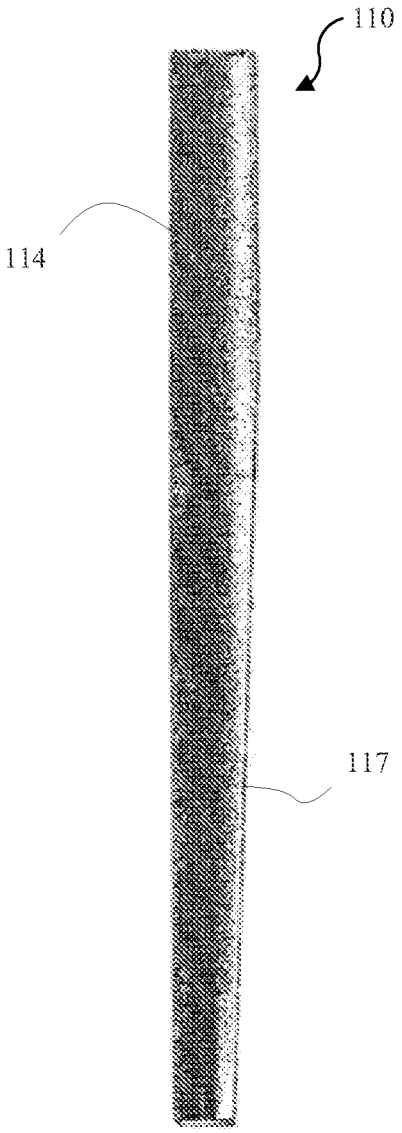
FIG. 15 is a side view of the metering rod shown in FIG. 14.
Figure 16:
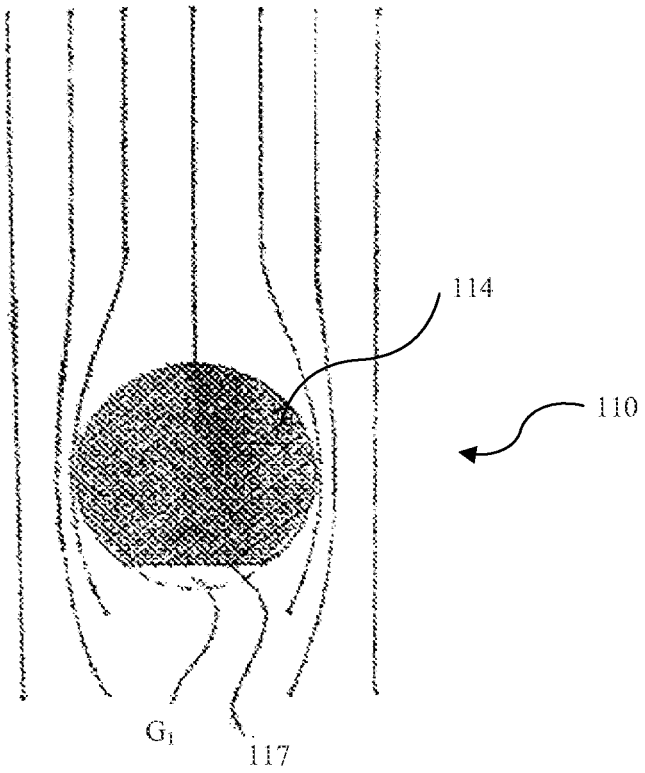
FIG. 16 is a cross-sectional view of the metering rod shown in FIG. 14 taken about line 16-16.

With reference to FIGS. 14 and 15, metering rod 110, according to an exemplary embodiment, includes a wake generator, in the form of a flat portion 117, which helps metering rod 110 atomize fuel more effectively when compared to traditional tapered needle valve arrangements. In this embodiment, the wake generator is a flat portion that is formed by grinding the metering rod at an angle. The flat ground portion is oriented at an angle with respect to the metering rod's axis "A" as shown in FIG. 15, for example. As air accelerates through the venturi, a portion of the metering rod within that airstream encounters the round cylinder 114 of metering rod 110. With further reference to FIG. 16, flow accelerates further within this local region near the surface of the metering rod, and reaches a peak velocity at "$V_p$" downstream along the metering rod approximately equal to one metering rod radius. Flow decelerates slightly beyond this point, until it separates from the surface near the flat portion 117 on the back of metering rod 110, creating a wake region "W" on flat portion 117. The differential pressure between the atmospheric pressure within the float bowl and the low pressure wake region draws liquid fuel up the flat portion 117 of the metering rod 110, where it is sheared off in the higher velocity airstream created by the disturbance of the cylindrical portion of the metering rod. It is the additional increase in shearing force and the distribution along the length of the rod that offers an improvement over a tapered needle valve arrangement.

A combination of features creates a system where liquid fuel is ordered and delivered directly into the region of airflow with the highest shear force. Fuel is directed to the corners formed where the cylindrical surface is interrupted by the flat surface. Droplets are then sheared into much finer particles than when they are simply lifted from the flat into the wake region. Finer atomization allows for more efficient combustion and reduces the production of harmful emissions.

The surface finish of the rod may be sufficiently fine to accurately meter fuel at the metering rod and nozzle interface, yet coarse enough to reduce surface tension effects and allow the fuel to wet into the flat surface of the rod. The cylindrical portion 114 of the rod 110 may be polished to as fine a finish as is economically feasible to reduce wear against the nozzle. A suitable surface finish in may be approximately 25 to 50 microns and, in at least one embodiment approximately 40-41 microns. In order to encourage fuel to wick into the rod, large surface discontinuities should be sufficiently reduced. Pockets, pores, or damage from manufacturing processes may all work against the smooth surface adhesion of fuel and discourage flow up the rod.

Figure 17:
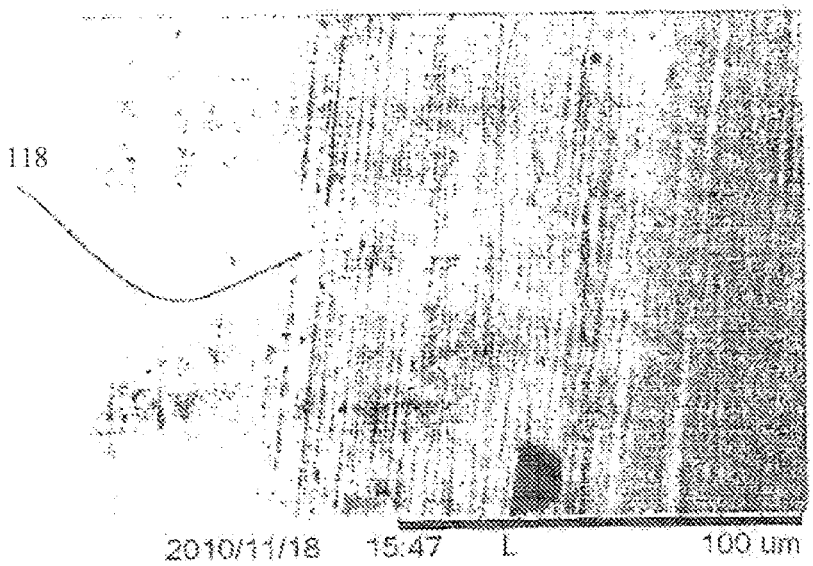
FIG. 17 is a dose up view of a portion of the flat on the metering rod shown in FIGS. 14-16.
Figure 18:
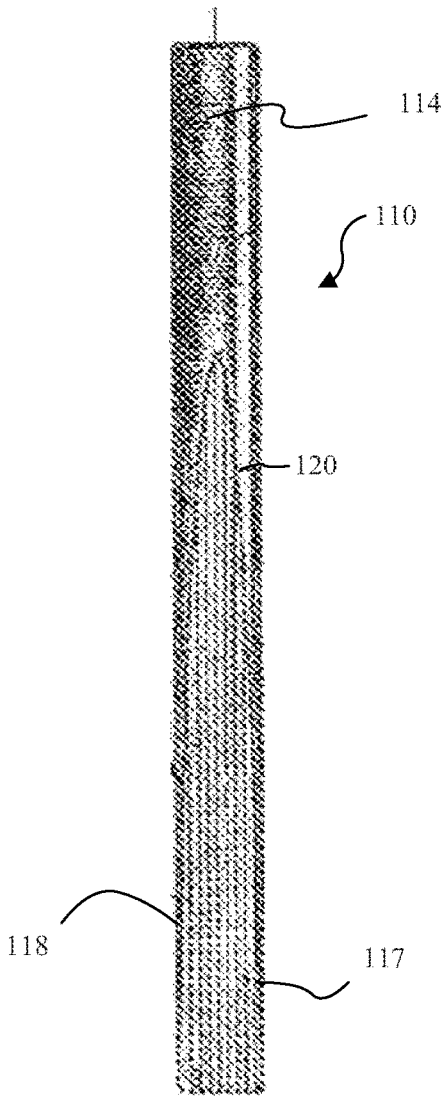
FIG. 18 is a schematic representation of the grooves fanned on the flat portion of the metering rod shown in FIGS. 14-17.

As seen in FIG. 17, the flat surface 117 of the metering rod 110 is comprised of a series of very small, non-intersecting grooves, for example, representative grooves 118. These grooves are also referred to as channels or microchannels. The primary orientation of the grooves is parallel with the slender axis "A" of the rod. Surface tension wetting and aerodynamic pressure forces guide fuel into the grooves, which direct it along the metering rod. The cross-wise scale of the grooves is quite small, on the order of hundreds of molecular lengths. These grooves may be formed by a variety of abrasive methods including, but not limited to grinding, honing, electrolytic grinding, lapping, or the like, to name but a few examples. As fuel is forced into the grooves, liquid is grouped into many small channels 118. As each channel intersects the cylindrical surface of the metering rod along edge 120 (see FIG. 18), the top of an individual channel acts as its own nozzle ejecting fuel into the free stream. Fuel sheared from the tops of these micro channels enters the flow at a much smaller dimension than those sheared from an ordinary surface. These drops which are smaller at their origin at the metering rod are then sheared into even finer droplets by the velocity gradients and turbulence within the carburetor venturi and engine intake tract.

Figure 19:
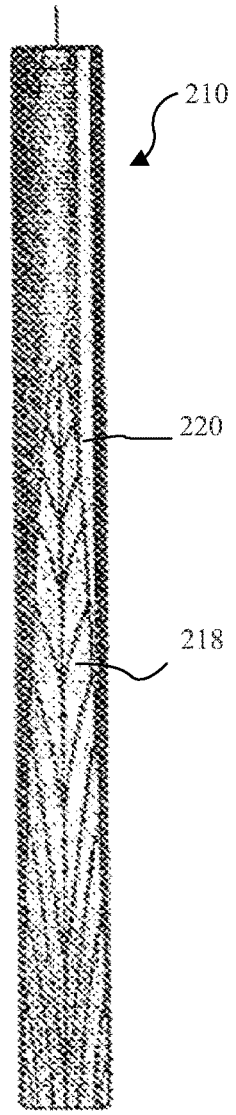
FIG. 19 is a front view of a metering rod according to another exemplary embodiment that schematically represents an alternative groove arrangement.

Linear grooves 118 provide good atomization for those grooves which terminate near the maximum cord length of the rod. However, many grooves would terminate near the peak of the ellipse (I.e. edge 120) in the wake region far from the high gradients near the outside edges. In another embodiment shown in FIG. 19, an additional advantage is then available by terminating as many grooves as possible near the outside regions of high velocity gradient. Thus, grooves 218 have a chevron or curved shape that follows along the long axis "A" of the metering rod before turning an arc toward the edge 220.

Figure 20:
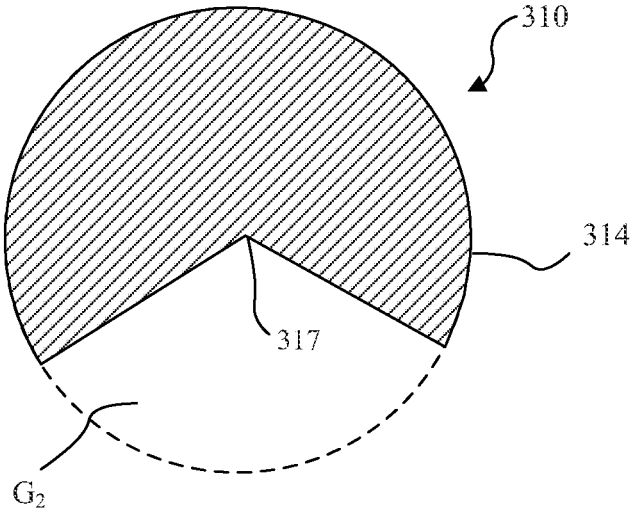
FIG. 20 is a cross-sectional view of a metering rod according to an alternative embodiment.
Figure 21:
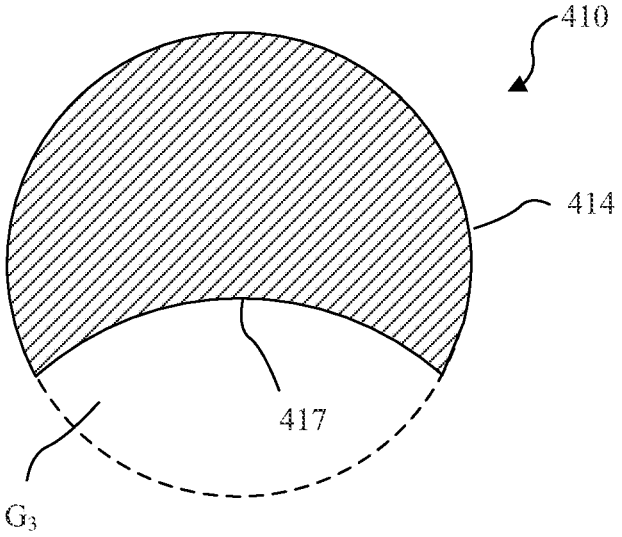
FIG. 21 is a cross-sectional view of a metering rod according to yet another alternative embodiment.

The low pressure inside the wake region behind the metering rod is a primary component in the driving pressure associated with moving liquid fuel into the venturi of the carburetor. The wake generator, such as flat portion 117, of the metering rod may be modified to enhance the formation of the wake and then also the fuel driving pressure. The wake generator of the metering rod can be augmented by a variety of shapes to enhance the wake. For example and without limitation, the wake generator may be in the form of a dihedral section 317 or concave conical section 417 as shown in FIGS. 20 and 21, respectively.

Returning briefly to FIG. 15, the wake generator may be formed at an angle with respect to rod axis "A" thereby varying the cross-sectional area "$G_1$" of the wake generator along the length of the metering rod. The wake generator may otherwise vary in size with respect to its cross-sectional area along the length of the metering rod. With reference to dihedral section 317 shown in FIG. 20, the shape or size of the wake generator's cross section may vary. For example, the angle of dihedron 317 may change along the length of the metering rod thereby changing the cross-sectional area "$G_2$" of the wake generator along the length of metering rod 310. The above are only examples, and the cross-sectional area of the wake generator may otherwise vary along the length of the metering rod.

Accordingly, the carburetor and methods, therefore, have been described with some degree of particularity directed to the exemplary embodiments. It should be appreciated, though, that the present invention is defined by the following claims construed in light of the prior art so that modifications or changes may be made to the exemplary embodiments without departing from the inventive concepts contained herein.

What is claimed is:

1. A metering rod for a carburetor, comprising:
- an elongated cylindrical rod extending along a rod axis and having opposed first and second end portions; and
- a wake generator formed on the cylindrical rod extending from the first end portion and varying in cross-sectional area along at least a portion of a length of the cylindrical rod; and
- a plurality of grooves formed on the wake generator;
- wherein the plurality of grooves include multiple grooves having an arcuate portion.

2. The metering rod of claim 1, wherein the wake generator comprises a flat region angled with respect to the rod axis and bordered by an elliptical edge.

3. The metering rod of claim 2, wherein the plurality of grooves are formed on the flat region and intersect the elliptical edge.

4. The metering rod of claim 1, wherein the plurality of grooves extend parallel to at least a portion of the rod axis.

5. The metering rod of claim 4, wherein the plurality of grooves each include an arcuate portion.

6. The metering rod of claim 1, wherein the wake generator comprises a concave cross-section.

7. The metering rod of claim 6, wherein the wake generator comprises a dihedral cross-section.

8. A metering rod for a carburetor, comprising:
- an elongated cylindrical rod extending along a rod axis and having opposed first and second end portions;
- a wake generator comprising a flat region angled with respect to the rod axis formed on the cylindrical rod; and
- a plurality of grooves formed on the flat region;
- wherein the plurality of grooves include multiple grooves having an arcuate portion.

9. The metering rod of claim 8, wherein the plurality of grooves extend parallel to at least a portion of the rod axis.

10. The metering rod of claim 8, wherein the plurality of grooves each include an arcuate portion.

11. The metering rod of claim 10, wherein the plurality of grooves follow the rod axis of the cylindrical rod and terminate non-parallel to the rod axis along an edge of the flat region.

12. The metering rod of claim 8, wherein a cylindrical portion of the rod has a surface finish of 25.0 to 50.0 microns.

13. The metering rod of claim 8, wherein a cylindrical portion of the rod has a surface finish of 40.0 to 41.0 microns.

14. The metering rod of claim 8, wherein the wake generator comprises a concave cross-section.

15. The metering rod of claim 14, wherein the wake generator comprises a dihedral cross-section.

16. A carburetor for an internal combustion engine, comprising:
- a body having an air inlet opening portion, an air outlet opening portion, and a throat portion extending therebetween;
- a fuel reservoir in fluid communication with the throat portion; and a slide assembly movably disposed in the body for movement across the throat portion, the slide assembly comprising:
  - a metering rod extending across the throat portion and into the fuel reservoir, wherein the metering rod comprises:
    - an elongated cylindrical rod extending along a rod axis and having opposed first and second end portions; and
    - a wake generator formed on the cylindrical rod extending from the first end portion and varying in cross-sectional area along at least a portion of a length of the cylindrical rod; and
    - a plurality of grooves formed on the wake generator;
    - wherein the plurality of grooves include multiple grooves having an arcuate portion.

17. The carburetor of claim 16, wherein the metering rod is in fluid communication with the fuel reservoir.

18. The carburetor of claim 17, wherein the wake generator comprises a flat region angled with respect to the rod axis and bordered by an elliptical edge, wherein the plurality of grooves intersect the elliptical edge.

19. The carburetor of claim 18, wherein the plurality of grooves are positioned to force fuel located within the fuel reservoir into the grooves and direct the fuel along at least a portion of the length of the metering rod.

* * * * *